US011408088B2

(12) United States Patent
Räisä

(10) Patent No.: US 11,408,088 B2
(45) Date of Patent: Aug. 9, 2022

(54) OBJECT COMPRISING A CHROMIUM-BASED COATING ON A SUBSTRATE

(71) Applicant: SAVROC LTD, Kuopio (FI)

(72) Inventor: Jussi Räisä, Kuopio (FI)

(73) Assignee: SAVROC LTD, Kuopio (FI)

( * ) Notice: Subject to any disclaimer, the term of this patent is extended or adjusted under 35 U.S.C. 154(b) by 0 days.

(21) Appl. No.: 17/439,567

(22) PCT Filed: Mar. 11, 2020

(86) PCT No.: PCT/FI2020/050153

§ 371 (c)(1),
(2) Date: Sep. 15, 2021

(87) PCT Pub. No.: WO2020/188145

PCT Pub. Date: Sep. 24, 2020

(65) Prior Publication Data

US 2022/0090286 A1 Mar. 24, 2022

(30) Foreign Application Priority Data

Mar. 15, 2019 (FI) ..... 20195194

(51) Int. Cl.
*C25D 5/06* (2006.01)
*C25D 5/00* (2006.01)
(Continued)

(52) U.S. Cl.
CPC ..... *C25D 5/625* (2020.08); *C25D 3/06* (2013.01); *C25D 5/14* (2013.01); *C25D 5/50* (2013.01)

(58) Field of Classification Search
None
See application file for complete search history.

(56) References Cited

U.S. PATENT DOCUMENTS 6,329,071 B1 12/2001 Kobayashi et al.
RE40,386 E * 6/2008 Kobayashi ..... C25D 5/617 205/104

(Continued)

FOREIGN PATENT DOCUMENTS

JP H04350193 A 12/1992

OTHER PUBLICATIONS

International Search Report for PCT/FI2020/050153, Prepared by the European Patent Office, dated Jun. 12, 2020, 3 pages.

*Primary Examiner* — Daniel J. Schleis
(74) *Attorney, Agent, or Firm* — Brooks Kushman P.C.

(57) ABSTRACT

An object including a chromium-based coating on a substrate and a method for its production are disclosed. The chromium-based coating having a first layer on the substrate, wherein the first layer has a top surface on the opposite side to the substrate and includes fissures within the first layer, and wherein the material of the first layer is predominantly formed of chromium and chromium carbide; the chromium-based coating further having a second layer on the first layer, the second layer at least partially filling the fissures in the first layer and at least partially covers the top surface of the first layer, wherein the material of the second layer is selected from a group consisting of: chromium oxide, carbon, and a combination of chromium oxide and carbon.

14 Claims, 3 Drawing Sheets

(51) Int. Cl.

| | |
|---|---|
| ***C25D 3/06*** | (2006.01) |
| ***C25D 5/14*** | (2006.01) |
| ***C25D 5/50*** | (2006.01) |

(56) References Cited

U.S. PATENT DOCUMENTS

| | | | |
|---|---|---|---|
| 2004/0099344 | A1 | 5/2004 | Nam et al. |
| 2018/0066375 | A1 | 3/2018 | Morgan et al. |
| 2019/0040540 | A1 | 2/2019 | Raisa |

* cited by examiner

OBJECT COMPRISING A CHROMIUM-BASED COATING ON A SUBSTRATE

CROSS-REFERENCE TO RELATED APPLICATION

This application is the U.S. national phase of PCT Application No. PCT/FI2020/050153 filed on Mar. 11, 2020, which claims priority to FI Patent Application No. 20195194 filed on Mar. 15, 2019, the disclosures of which are incorporated in their entirety by reference herein.

TECHNICAL FIELD

The present disclosure relates to an object comprising a chromium-based coating on a substrate. The present disclosure further relates to a method for producing an object comprising a chromium-based coating on a substrate.

BACKGROUND

Objects which are utilized in demanding environmental conditions often require e.g. mechanical or chemical protection, so as to prevent the environmental conditions from affecting the object. Protection to the object can be realized by applying a coating thereon, i.e. on the substrate. Disclosed are protective coatings for various purposes; hard-coatings that protect the substrate from mechanical effects and diffusion barriers for protection against chemical effects. However, the protective coatings often include small pores and pin holes as defects. These defects are often called residual porosity. These properties of the coating may result in serious degradation of the barrier properties of the coating. The pores and pin holes in e.g. a chemical barrier may enable diffusion of material through these defects from the environment onto the substrate which the coating is intended to protect. Pores and pin holes may also e.g. deteriorate the mechanical properties of the protective coating.

SUMMARY

An object comprising a chromium-based coating on a substrate is disclosed. The chromium-based coating may comprise a first layer, wherein the first layer has a top surface on the opposite side to the substrate and comprises fissures within the first layer. The chromium-based coating may further comprise a second layer on the first layer, the second layer at least partially filling the fissures of the first layer, and at least partially covers the top surface of the first layer. The material of the first layer may be predominantly formed of chromium and chromium carbide. The material of the second layer may be selected from a group consisting of: chromium oxide, carbon, and a combination of chromium oxide and carbon.

A method for producing an object comprising a chromium-based coating on a substrate is disclosed. The method may comprise: depositing on the substrate a first layer comprising a top surface on the opposite side to the substrate, by subjecting the substrate to at least two electroplating cycles from a trivalent chromium bath, wherein the first layer comprises fissures within the first layer. The method may further comprise subjecting the first layer deposited on the substrate to at least one heat treatment at a temperature of 300-1200° C. to form a second layer on the first layer, to at least partially fill fissures in the first layer, and to at least partially cover the top surface of the first layer. The material of the first layer may be predominantly formed of chromium and chromium carbide, and the material of the second layer may be selected from a group consisting of: chromium oxide, carbon, and a combination of chromium oxide and carbon.

BRIEF DESCRIPTION OF THE DRAWINGS

The accompanying drawings, which are included to provide a further understanding of the embodiments and constitute a part of this specification, illustrate embodiments and together with the description help to explain the principles of the above. In the drawings.

DETAILED DESCRIPTION

Figure 1:
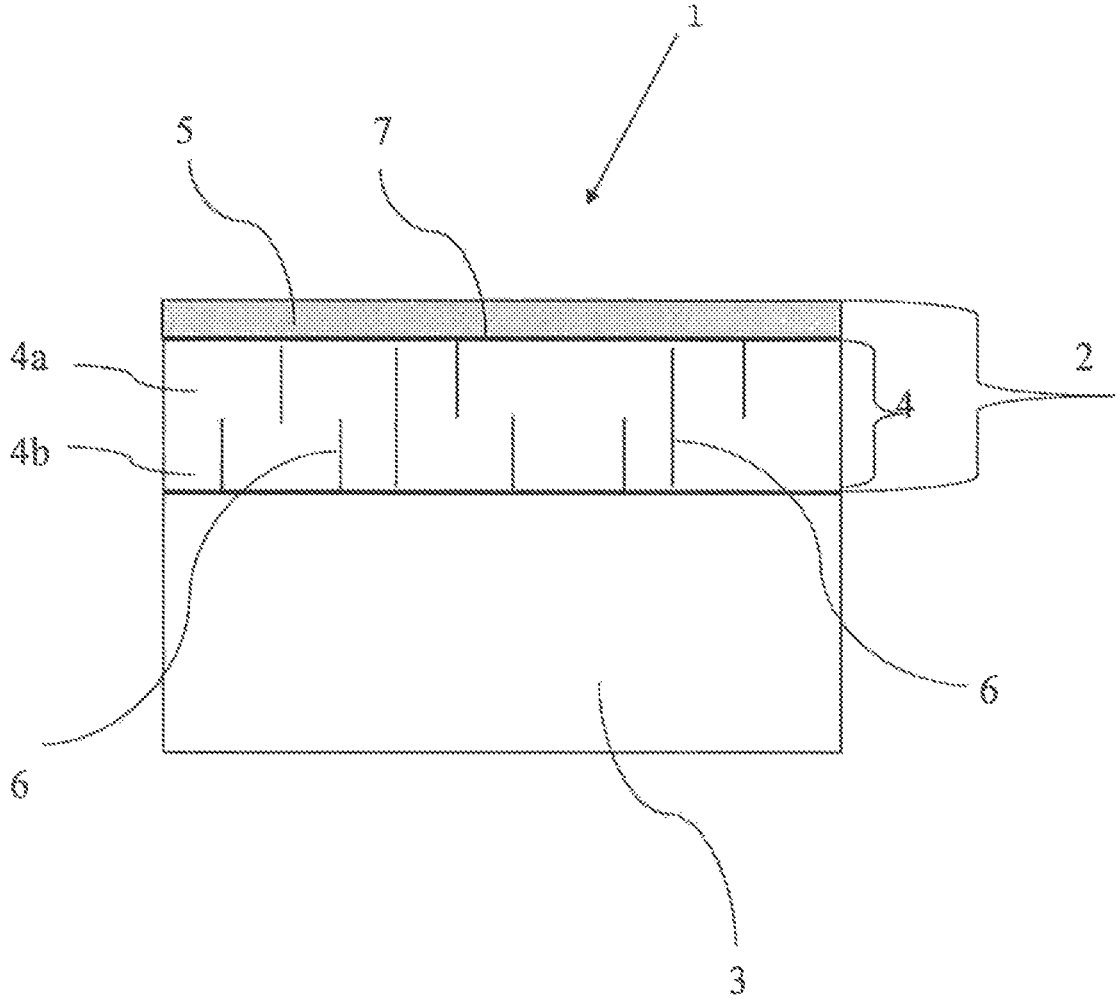
FIG. 1 schematically illustrates one embodiment of the object comprising a chromium-based coating on a substrate.

The present disclosure relates to an object comprising a chromium-based coating on a substrate, the chromium-based coating comprising a first layer on the substrate, wherein the first layer has a top surface on the opposite side of the substrate and comprises fissures within the first layer, and wherein the material of the first layer is predominantly formed of chromium and chromium carbide, the chromium-based coating further comprising a second layer on the first layer, the second layer at least partially filling the fissures in the first layer and at least partially covers the top surface of the first layer, wherein the material of the second layer is selected from a group consisting of: chromium oxide, carbon, and a combination of chromium oxide and carbon.

The present disclosure further relates to a method for producing an object comprising a chromium-based coating on a substrate, wherein the method comprises:

depositing a first layer comprising a top surface on the substrate by subjecting the substrate to at least two electroplating cycles from a trivalent chromium bath, wherein the first layer comprises fissures within the first layer, and subjecting the first layer deposited on the substrate to at least one heat treatment at a temperature of 300-1200° C. to form a second layer on the first layer, to at least partially fill fissures in the first layer and to at least partially cover the top surface of the first layer, wherein the material of the first layer is predominantly formed of chromium and chromium carbide, and wherein the material of the second layer is selected from a group consisting of: chromium oxide, carbon, and a combination of chromium oxide and carbon.

In this specification, unless otherwise stated, the term that the material of the first layer is "predominantly formed" of chromium and chromium carbide, is used to define that a majority of the material of the first layer is formed of chromium and chromium carbide but that also other components may be present. In one embodiment, at least 55 weight-%, or at least 60 weight-%, or at least 70 weight-%, or at least 80 weight-%, or at least 90 weight-%, or at least 95 weight-%, or at least 99 weight-%, of the material of the first layer is chromium and chromium carbide.

In one embodiment, the material of the first layer comprises, in addition to chromium and chromium carbide, a compound of nitrogen. In one embodiment, the material of the first layer comprises, in addition to chromium and chromium carbide, chromium nitride. In one embodiment, the material of the first layer is predominantly formed of chromium, chromium carbide, and a compound of nitrogen. In one embodiment, the material of the first layer is predominantly formed of chromium, chromium carbide, and chromium nitride. In one embodiment, at least 55 weight-%, or at least 60 weight-%, or at least 70 weight-%, or at least 80 weight-%, or at least 90 weight-%, or at least 95 weight-%, or at least 99 weight-%, of the material of the first layer is chromium, chromium carbide, and a compound of nitrogen. In one embodiment, at least 55 weight-%, or at least 60 weight-%, or at least 70 weight-%, or at least 80 weight-%, or at least 90 weight-%, or at least 95 weight-%, or at least 99 weight-%, of the material of the first layer is chromium, chromium carbide, and chromium nitride.

In one embodiment, the material of the first layer comprises predominantly or consists of chromium and chromium carbide. In one embodiment, the material of the first layer comprises predominantly or consists of chromium, chromium carbide, and a compound of nitrogen. In one embodiment, the material of the first layer comprises predominantly or consists of chromium, chromium carbide, and chromium nitride. In one embodiment, the material of the second layer comprises or consists of chromium oxide. In one embodiment, the material of the second layer comprises or consists of carbon. In one embodiment, the material of the second layer comprises or consists of chromium oxide and carbon. In one embodiment, the second layer comprises or consists of at least one layer of chromium oxide and at least one layer of carbon.

Examples of chromium nitrides that may be present are CrN, $Cr_2N$, or any combination of these.

In one embodiment, the chromium-based coating comprises a compound of nitrogen, such as chromium nitride. Chromium nitride may affect the hardness and/or the gliding properties of the coating.

In one embodiment, the object comprising a chromium-based coating on a substrate does not comprise a layer of nickel. In one embodiment, the chromium-based coating does not comprise a layer of nickel. In one embodiment, the substrate does not comprise a layer of nickel.

In this specification, unless otherwise stated, the terms "electroplating", "electrolytic plating" and "electrodeposition" are to be understood as synonyms. By depositing a (first) layer on the substrate is herein meant depositing a layer directly on the substrate to be coated or on the previous layer (sublayer) that has been deposited on the substrate. In the present disclosure, the first layer is deposited through electroplating from a trivalent chromium bath. In this connection, the wording electroplating "from a trivalent chromium bath" is used to define a process step in which the deposition is taking place from an electrolytic bath in which chromium is present substantially only in the trivalent form. The trivalent chromium bath can be any commercially available trivalent chromium bath or the trivalent chromium bath can be prepared from any commercially available component(s).

As a result of the production process, the first layer comprises fissures of different size and shape within the first layer. In one embodiment, at least some of the fissures are surrounded by the material of the first layer. Such fissures do not open through to the top surface of the first layer but lie within the first layer. In one embodiment, at least some of the fissures in the first layer opens through to the top surface of the first layer. In one embodiment, the second layer at least partially fills the fissures of the first layer such that the second layer confirms to the shape of the surface of the fissures. In one embodiment, the second layer fills and/or clogs essentially all of the fissures of the first layer.

In one embodiment, the method of the present disclosure is used to protect the first layer and/or the substrate from effects caused by an interaction of the first layer and/or the substrate with the environment.

The material of the first layer is predominantly formed of chromium and chromium carbide. The term "chromium carbide" is herein to be understood to include all the chemical compositions of chromium carbide. Examples of chromium carbides that may be present in the first layer are $Cr_3C_2$, $Cr_7C_3$, $Cr_{23}C_6$, or any combination of these. The amount and ration between different chromium carbide compounds can vary. Chromium carbides has the added utility of improving the hardness of the chromium-based coating.

The material of the second layer is selected from a group consisting of: chromium oxide, carbon, and a combination of chromium oxide and carbon. Examples of chromium oxides that may be present in the second layer are $CrO_3$, CrO, $Cr_2O_3$, or any combination of these.

As is clear to the skilled person, the first layer and the second layer may in addition to the materials presented above contain minor amounts of residual elements and/or compounds originating from manufacturing process, such as the electroplating process and/or the heat treatment process. Examples of such further elements are copper (Cu), zinc (Zn), aluminum (Al), and molybdenum (Mo), and any compounds including the same.

The inventors surprisingly found out that when the first layer deposited on the substrate was subjected to the at least one heat treatment a second layer was formed on the surface of the first layer. In one embodiment, the material of the second layer is chromium oxide. Without limiting to any specific theory about why a chromium oxide layer is formed on the first layer as a result of subjecting the deposited first layer to the at least one heat treatment, it should be considered that under heat treatment at the specified temperature, the surface of the first layer, being formed from a trivalent chromium bath, may react with the surrounding air and the oxygen present therein, thereby forming a layer of chromium oxide. Thus, a chromium oxide layer is formed on the top surface of the first layer. The inventors surprisingly found out that the same phenomenon also happens in the fissures, formed within the first layer during the electroplating process. As a result of the electroplating process, the fissures may remain filled with air that may then react with the chromium of the first layer during heat treatment. The formation of a layer of chromium oxide on the first layer has the added utility of at least partly filling or clogging the fissures present in the first layer. At least some or all of the fissures may be completely filled with chromium oxide.

The material of the second layer that forms into the fissures of the first layer has the added utility of increasing the durability of the first layer as voids causing fragility to the first layer are filled. Additionally, the barrier properties of the first layer may be improved as the material of the second layer clogs or closes off passages in the first layer through which material, e.g. molecules in the gas phase, may diffuse or otherwise drift from the environment through the first layer onto the substrate. The presented coating thus has the added utility of providing excellent mechanical and chemical protection for the substrate and can be simultaneously used e.g. as a corrosion barrier and a hard coating.

In this context "a fissure" should be understood as any hollow region within a layer, including a fissure, a pore, a pin hole or the like. The fissures referred to in this specification should be understood as microscopically small defects on or inside the layer. These defects are part of the residual porosity of the layer, which results from the electroplating employed for the layer.

The method as disclosed in the present specification may provide a way to fabricate a chromium-based coating that may act as an efficient barrier against material transfer through the coating, and additionally may possess good mechanical strength and durability. The method and the object of the present specification efficiently inhibit chemical reactions from occurring between the environment and the substrate as material is not able to diffuse or otherwise drift through the chromium-based coating from the environment onto the surface of the substrate under the chromium-based coating. The at least partial filling of the fissures in the first layer also improves the mechanical stability of the chromium-based coating making it more durable and improving the mechanical protection of the substrate.

By "the top surface" of the first layer, it is meant the surface of the first layer that is on the opposite side compared to the substrate and that is exposed to the surrounding before the second layer is formed thereon. Covering the entire top surface with the chromium oxide layer has the added utility of enabling to efficiently prevent the surrounding from affecting the underlying first layer and the substrate.

In one embodiment, the material of the second layer is chromium oxide and the second layer covers the entire top surface of the first layer for protecting the first layer and/or the substrate from effects caused by an interaction of the first layer and/or the substrate with the environment.

In one embodiment, the effects caused by the interaction of the first layer and/or the substrate with the environment are caused by a chemical interaction. In one embodiment, the effects caused by the interaction of first layer and/or the substrate with the environment are caused by an electrochemical interaction. In one embodiment, the effects caused by the interaction of the first layer and/or the substrate with the environment are the effects of corrosion. In an embodiment, the chemical interaction is an interaction causing corrosion. In one embodiment, the corrosion resistance of the object is at least 24 h, or at least 48 h, or at least 96 h, or at least 168 h, or at least 240 h, or at least 480 h. The corrosion resistance can be determined in accordance with standard EN ISO 9227 NSS (neutral salt spray) rating 9 or 10 (2017).

The method and the protective coating as disclosed in the present specification are well suited for protecting metal substrates from corrosion as coatings where the second layer conforms to the shape of the surface of the fissures in the first layer can efficiently reduce diffusion of water (moisture) and/or oxygen through the coating onto the substrate. Applying the second layer on the first layer has the added utility of providing e.g. a good corrosion barrier by clogging the fissures in the first layer. The materials of the first layer and the second layer may also efficiently serve the purpose of a hard coating mechanically protecting the substrate.

In one embodiment, the first layer is formed of at least two sublayers arranged one upon the other. In one embodiment, the material of the at least two sublayers is the one and the same material. In one embodiment, the sublayers are predominantly formed of chromium and chromium carbide. In one embodiment, the sublayers comprise predominantly or consist of chromium and chromium carbide. In one embodiment, the sublayer situated closest to the second layer is formed predominantly of chromium carbide. In one embodiment, the sublayer situated closest to the second layer comprises predominantly or consists of chromium carbide. When the first layer is formed of at least two sublayers, one is able to reduce the likelihood of the first layer comprising fissures that are extending from the top surface all the way through the first layer to the substrate.

In one embodiment, the second layer is at least partially embedded and/or diffused into the first layer.

The thickness of the chromium-based coating can vary depending on the application where the object is to be used. The thickness of the chromium-based coating may depend on the number and thickness of the layers it comprises. In on embodiment, the thickness of the chromium-based coating is 0.05-200 μm, or 0.5-100 μm, or 0.3-5 μm.

In one embodiment, the thickness of the first layer is at least 0.5 μm, or at least 1 μm, or at least 3 μm, or at least 5 μm, or at least 10 μm, or at least 20 μm, or at least 30 μm, or at least 50 μm. The thickness of the first layer may vary depending on the end product, i.e. where the object is to be used. In one embodiment, the thickness of one sublayer is 0.2-50 μm, or 1-30 μm, or 3-20 μm, or 5-10 μm. In one embodiment, the thickness of the second layer is 2-500 nm, or 5-480 nm, or 10-450 nm, or 20-400 nm, or 50-300 nm, or 60-200 nm, or 70-100 nm.

In one embodiment, the chromium-based coating has a Vicker microhardness value of 900-2200 HV, or 1000-2000 HV, or 1200-1800 HV, or 1500-1700 HV. In one embodiment, the material of the second layer is chromium oxide and the second layer has a Vicker microhardness value of 2000-4000 HV, or 3000-3500 HV, or 2500-2800 HV. In one embodiment, the Vicker microhardness is measured according to standard ISO 14577-1:2015. In one embodiment, the hardness of first layer may vary depending on the site of the first layer where the measurement is made. The fact that the hardness of the first layer may vary is a result of different phases being formed in the first layer. These different phases may have different hardness values.

By a "substrate" is herein meant any component or body on which the chromium-based coating according to the present disclosure is coated on. Generally, the chromium-based coating according to the present disclosure can be used on variable substrates. In one embodiment, the substrate consists of metal, a combination of metals, or a metal alloy. In one embodiment, the substrate is made of steel, copper, or nickel. The substrate can be made of ceramic material. The substrate does not need to be homogenous material. In other words, the substrate may be heterogeneous material. The substrate can be layered. For example, the substrate can be a steel object coated by a layer of nickel, or nickel phosphorus alloy (Ni—P). In one embodiment, the substrate is a cutting tool, for example a cutting blade. In one embodiment, the substrate is a cutting tool comprising metal.

In one embodiment, the object is a gas turbine, shock absorber, hydraulic cylinder, linked pin, joint pin, a bush ring, a round rod, a valve, a ball valve, or an engine valve.

In one embodiment, depositing a first layer by subjecting the substrate to at least two electroplating cycles comprises subjecting the substrate to two, three, four, five, six, seven, eight, nine, or ten electroplating cycles. In one embodiment, the method comprises continuing one electroplating cycle for 1 minute-4 hours, or 10-60 minutes, or 20-40 minutes, or for about 30 minutes.

In one embodiment, each of the at least two electroplating cycles is separated from another electroplating cycle in time so as to form a first layer of at least two sublayers arranged one upon the other. In one embodiment, the sublayers are formed by electroplating from a trivalent chromium bath in cycles, wherein each of the cycles is separated from one another in time by stopping the electroplating process for a predetermined period of time. In one embodiment, each of the at least two electroplating cycles is separated from another electroplating cycle by at least 0.1 milliseconds, or at least 1 second, or at least 10 seconds, or at least 30 seconds, or at least 1 minute, or at least 5 minutes, or at least 10 minutes. In one embodiment, each of the at least two electroplating cycles is separated from another electroplating cycle by 0.1 milliseconds-3 minutes, or 1 second-60 seconds, or 10-30 seconds. In one embodiment, each of the at least two electroplating cycles is separated from another electroplating cycle by 0.5-10 minutes, or 2-8 minutes, or 3-7 minutes. By separating the at least two electroplating cycles in time, one is able to form a first layer comprising or consisting of at least two sublayers. Producing the first layer by at least two electroplating cycles has the added utility of different sublayers being formed. The separate sublayers may have fissures in different positions or places thereof. Thus, the like hood that there would be present fissure(s) extending from the substrate up to the top surface is reduced or minimized.

In on embodiment, the different electroplating cycles are separated from each other by stopping the current to pass through the trivalent chromium bath. In one embodiment, the substrate to be subjected to the electroplating is removed from the trivalent chromium bath for a certain period of time and then put back into the bath for continued electroplating. In one embodiment, the substrate to be subjected to electroplating is removed from one trivalent chromium bath for a certain period of time and placed in another trivalent chromium bath for the sequential electroplating cycle to take place.

The electroplating step can be carried out using any commercially available trivalent chromium (Cr(III)) bath. One example of an electrolyte solution that can been used in the trivalent chromium coating is the one sold by Atotech Deutschland GmbH under trade name Trichrome Plus®. In one embodiment, the electroplating step is carried out using a chromium bath as disclosed in WO 2018/185154. The current density during the electroplating cycle can influence the exact composition, as the relative coating efficiencies of different ions vary according to the current density. In one embodiment, the current density during the coating is 10-100 A $dm^{-2}$, or 15-50 A $dm^{-2}$. It is thus possible to use a current density of 15 A $dm^{-2}$. Also current densities, such as 20 or 40 A $dm^{-2}$ are suitable.

In one embodiment, the method comprises polishing the top surface of the first layer before subjecting the first layer deposited on the substrate to the at least one heat treatment. Polishing or grinding the top surface of the first layer before subjecting the same to the at least one heat treatment, enables the formation of a smooth top surface on which the second layer is formed. In one embodiment, the method comprises providing the top surface of the first layer with a roughness value (Ra) of at most 0.1 μm, or at most 0.2 μm, or at most 0.3 μm, before subjecting the first layer to the heat treatment. The roughness value can be determined in accordance with EN ISO 4288:1998. In one embodiment, the top surface of the first layer is polished to a roughness value required by the final application of the object.

The method according to the present disclosure may comprise more than one heat treatment. In one embodiment, the method comprises two, three, or even more than three heat treatments. The heat treatments do not need to be identical. The object can be cooled after the at least one heat treatment. Water or air can be used for cooling.

The at least one heat treatment is carried out at a temperature of 300-1200° C. However, within this temperature range various alternatives exist. In one embodiment, the at least one heat treatment is carried out at a temperature of 400-1100° C., or 500-1000° C., or 600-900° C., or 700-800° C. In one embodiment, at least two heat treatments are used, wherein the temperatures in the at least two heat treatments are different. By a heat treatment is herein meant, unless otherwise stated, a treatment in which the temperature of the first layer reaches the given temperature at least momentarily. A heat treatment can be carried out, for instance, in a conventional gas furnace in ambient gas atmosphere or in a protective gas atmosphere. Heat treatment can be carried out in a furnace, or by induction, flame heating, laser heating or salt bath heat treatment. The heat treatment can also be reached during the use. In one embodiment, the length of a heat treatment is 0.1 s-72 h. For induction heating, flame heating, laser heating and salt bath heat treatment, the duration of the heat treatment is typically shorter than for furnace heating. In on embodiment, the length of a heat treatment is 0.5-30 s. In one embodiment, the length of a heat treatment is 1 minute-10 hours, or 5 minutes-8 hours, or 15 minutes-6 hours, or 30 minutes-3 hours. In one embodiment, the length of a heat treatment is 5-60 min, or 15-45 min. The length of the heat treatment may vary depending on the temperature of the heat treatment. E.g. when using a higher temperature, such as 600-1200° C., a shorter period of time may be sufficient whereas using a lower temperature, such as 300-500° C., at least e.g. 1 h may be needed.

In one embodiment, the object comprises an intermediate layer between the first layer and the second layer. Such an intermediate layer may be formed when the at least one heat treatment is carried out at a temperature of at least 500° C. In one embodiment, the object does not comprise an intermediate layer between the first layer and the second layer.

In one embodiment, the at least one heat treatment is carried out at a temperature of 600-1200° C., such as 700-1000° C., for e.g. 15-60 minutes, in e.g. a furnace. Carrying out the heat treatment at such a temperature has the added utility of providing the second layer with properties making the attachment of e.g. an epoxy adhesive layer thereon possible. In one embodiment, the object comprises an adhesive layer on the second layer. In one embodiment, the adhesive layer is an epoxy adhesive layer.

In one embodiment, the at least one heat treatment is carried out at a temperature of 300-580° C., such as 400-500° C., for e.g. 3-7 hours, such as 5-6 hours, in a furnace. Carrying out the heat treatment at such a temperature has the added utility of providing the second layer with properties making it non-sticky. Alternatively, using induction heating at a high temperature, such as 600-800° C., for e.g. 0.5-30 s, may provide the second layer with properties making it non-sticky.

In one embodiment, the material of the second layer is chromium oxide. As the electroplating is carried out using a trivalent chromium bath, the chromium oxide formed on the first layer may be in the form of $Cr_2O_3$.

In one embodiment, subjecting the first layer to the at least one heat treatment comprises simultaneously exposing the first layer to reactions with carbon. The inventors surprisingly found that a second layer, wherein the material of the second layer is carbon or a combination of carbon and chromium oxide, can be formed on the first layer when exposing the first layer to reaction with carbon during the heat treatment. Providing a second layer of carbon on the first layer has the added utility of providing a black appearance to the coated object. In one embodiment, the carbon may originate from a metal bar present during the heat treatment. Alternatively, the carbon may originate from the inner surface material of the furnace where the heat treatment takes place. The carbon may originate from any other carbon source but not air.

In one embodiment, the material of the second layer is carbon. In one embodiment, the material of the second layer is a combination of chromium oxide and carbon. In the case both chromium oxide and carbon are present in the second layer this will result in that some areas of the second layer are areas of carbon while other areas are areas of chromium oxide.

The object disclosed in the current specification has the added utility of being well suited for applications wherein hardness of the object is relevant. The materials of the chromium-based coating have the added utility of providing the substrate a hardness suitable for specific applications requiring high durability of the object. The chromium-based coating has the added utility of protecting the underlying substrate from effects caused by the interaction with the environment during use. The chromium-based coating has the added utility of providing a good corrosion resistance. The chromium-based coating further has the added utility of being formed from trivalent chromium, whereby the environmental impact is less than when using hexavalent chromium. Further, the method as disclosed in the current specification has the added utility of being a safer production method for a chromium-based coating than if hexavalent chromium is used.

EXAMPLES

Reference will now be made in detail to various embodiments, examples of which are illustrated in the accompanying drawings.

The description below discloses some embodiments in such a detail that a person skilled in the art is able to utilize the embodiments based on the disclosure. Not all steps or features of the embodiments are discussed in detail, as many of the steps or features will be obvious for the person skilled in the art based on this specification.

For reasons of simplicity, item numbers will be maintained in the following exemplary embodiments in the case of repeating components.

FIG. 1 illustrates schematically one embodiment of the object comprising a chromium-based coating on a substrate. The object of FIG. 1 comprises a chromium-based coating 2 on a substrate 3. The chromium-based coating 2 comprises a first layer 4 on the substrate 3. The first layer has a top surface 7 on the opposite side to the substrate and comprises fissures 6. Some of the fissures opens through to the top surface. The first layer as disclosed in FIG. 1 comprises two sublayers (4*a*,4*b*), which are arranged one upon the other. The sublayers may be formed by electroplating from a trivalent chromium bath in cycles, wherein each of the cycles are separated from one another in time by stopping the electroplating process for a predetermined period of time. The sublayers are predominantly formed of chromium and chromium carbide.

On the first layer 4 a second layer 5 is formed. The second layer 5 at least partially fills the fissures 6 in the first layer. In addition the second layer 5 may cover the top surface of the first layer and thus protects from interactions with the environment. The material of the second layer 5 can be selected from a group consisting of: chromium oxide, carbon, and a combination of chromium oxide and carbon.

Example 1—Preparing a Chromium-Based Coating on a Substrate

In this example different objects, each comprising a chromium-based coating on a substrate, were prepared.

Firstly, the substrates were pre-treated by cleaning the metal substrates, i.e. CK45 steel substrates, and providing thereon by electroplating and as a part of the substrate a nickel layer having a thickness of about 3-4 μm. Thereafter the substrates were rinsed with water after which the chromium-based coating was formed on the substrate.

A trivalent chromium-containing bath was prepared as is known in the art. An electrolyte solution comprising 20-23 g $l^{-1}$ trivalent chromium ions and 60-65 g $l^{-1}$ boric acid was used. $NiCl_2$ was added to the electrolyte solution to achieve $Ni^{2+}$ concentration of 50 mg $l^{-1}$ (approximately 0.85 mM). The bath was subjected to a normal initial plating, after which it was ready for use.

A first layer was deposited on each of the substrates by subjecting the substrates to four electroplating cycles. Each of the electroplating cycles was carried out at a current density of 17 A $dm^{-2}$ for 7 minutes. Between each of the electroplating cycles a 1 minute stop was used keeping the substrates to be deposited in the chromium-containing bath but without allowing any current to pass the bath. I.e. in this example, the substrates were allowed to stay in the chromium-containing bath while current was stopped. However, in other embodiments the substrate could equally well be removed from the chromium-containing bath during the current stops or alternatively be placed in another chromium-containing bath for the preceding electroplating cycle to be taken place in that chromium-containing bath.

As a result, a first layer comprising four sublayers was formed on each of the substrate. The first layer predominantly comprised chromium and chromium carbide.

The substrates with the first layers deposited thereon were then rinsed and subjected to heat treatment at different temperatures and for different periods of time as shown in the below table. The hardness of the chromium-based coating of the prepared objects was measured. The results are presented in the below table.

| Sample | 1 | 2 | 3 | 4 | 5 |
|---|---|---|---|---|---|
| Temperature of the heat treatment (° C.) | furnace | | | | induction |
| | 400 | 500 | 700 | 1000 | 700 |
| Duration of the heat treatment | 6 h | 6 h | 0.5 h | 0.5 h | 0.5 s |
| Thickness of the second layer (chromium oxide) (nm) | 197 | 147 | 200 | 116 | 71 |
| Hardness ($HV_{0.05}$) | 1780 | 1811 | 1850 | 1680 | 1860 |

Each of the samples 1-5 were analyzed with Scanning Electron Microscope (SEM). The samples were prepared with a broad ion beam (BIB). The results of these measurements can be seen in FIGS. 2*a*-2*e* and 3*a*3*e*, respectively.

Example 2—Preparing a Chromium-Based Coating on a Substrate

In this example an object comprising a chromium-based coating on a substrate was prepared.

Firstly, a substrate was pretreated as described in example 1. After the pretreatment and the preparation of the trivalent chromium bath, a first layer comprising predominantly chromium and chromium carbide was deposited on the substrate by subjecting the substrate to four electroplating cycles. Each of the electroplating cycles was carried out at a current density of 17.5 A $dm^{-2}$ (voltage 4.5 V) for 7 minutes. Between each of the electroplating cycles a 1 minute stop was used keeping the substrates to be deposited in the chromium-containing bath but without allowing any current to pass the bath. A titanium mesh coated with MMO (mixed metal oxide) was used as the anode. As a result, a first layer comprising four sublayers was formed on the substrate. The substrate with the first layer deposited thereon was then rinsed.

The roughness of the top surface of the formed first layer was measured and the Ra value was 0.6 μm. The thickness of the first layer was 18 μm. Before subjecting the same to the heat treatment, the top surface was polished to a Ra value of 0.2. Thereafter, the heat treatment was carried out by induction heating at 700° C. for 10 s. The surface roughness did not change as a result of the heat treatment and the Ra value was measured to be about 0.2. The thickness of the chromium oxide layer that was formed on the first layer was about 71 nm.

Figure 2A:
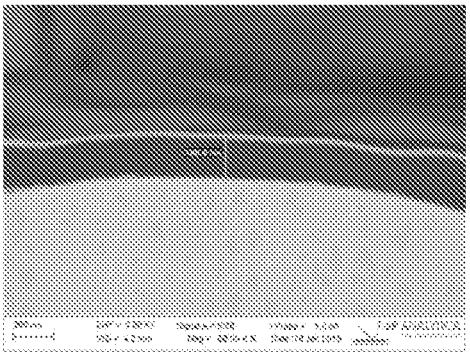
FIGS. 2*a*-2*e* discloses results of measurements in example 1.
Figure 2B:
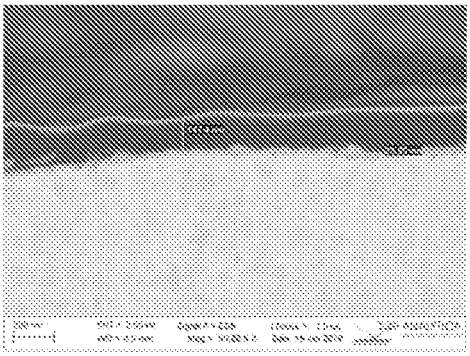
Figure 2C:
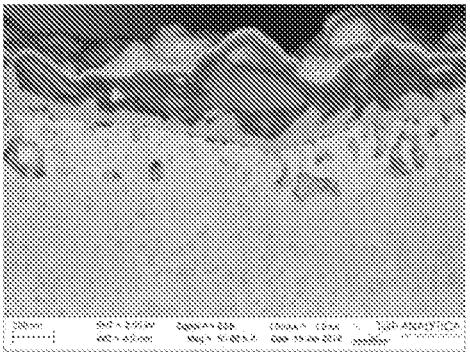
Figure 2D:
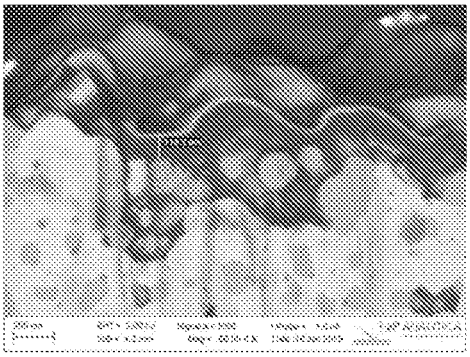
Figure 2E:
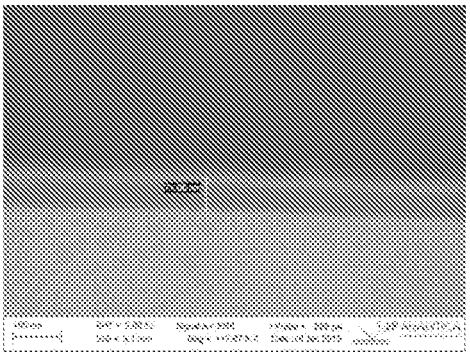
Figure 3A:
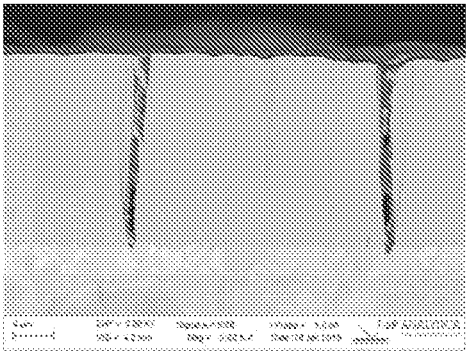
FIGS. 3*a*-3*e* discloses results of measurements in example 1.
Figure 3B:
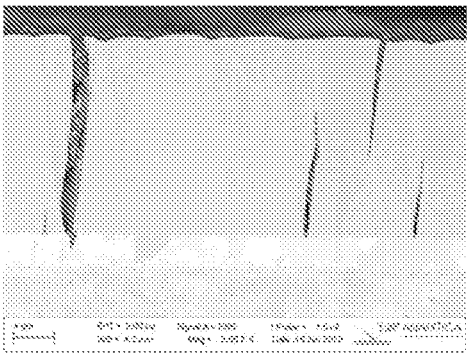
Figure 3C:
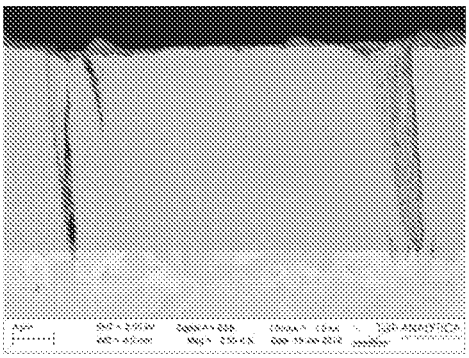
Figure 3D:
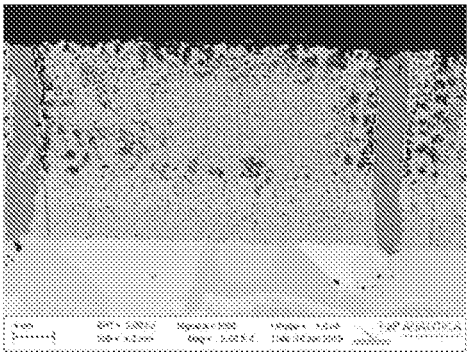
Figure 3E:
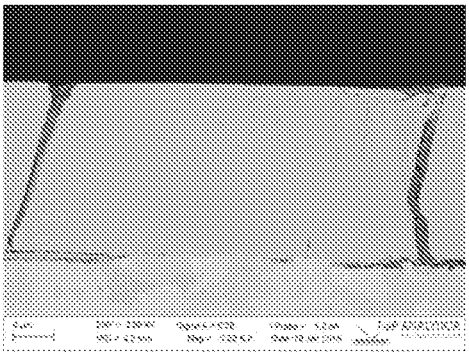

A SEM image, prepared as above presented, of the formed object is presented in FIG. 2*e*.

In a corresponding manner as above described, another substrate was coated following the above provided description but with the difference that the step of polishing the surface of the coating was done only after the heat treatment. Based on the performed tests, it was noted that polishing after the heat treatment resulted in the chromium oxide layer, formed during the heat treatment, being removed. This affected the corrosion resistance of the object.

The corrosion resistance of both of the prepared objects were measured according to standard EN ISO 9227 NSS (neutral salt spray) rating 9 or 10 (2017). Based on the conducted tests, the corrosion resistance of the object, wherein the polishing was carried out before the heat treatment, was about 200 h, whereas the corrosion resistance of the objet, wherein the polishing was carried out after the heat treatment was about 2 h. The results indicated that effect of the formed chromium oxide layer being able to protect the first layer and the substrate from effects of corrosion.

Example 3—Preparing a Chromium-Based Coating on a Substrate

In this example an object comprising a chromium-based coating on a substrate was prepared.

Firstly, a substrate was pretreated as described in example 1. After the pretreatment and the preparation of the trivalent chromium bath, a first layer comprising predominantly chromium carbide and chromium was deposited on the substrate by subjecting the substrate to four electroplating cycles. Each of the electroplating cycles was carried out at a current density of 17.5 A $dm^{-2}$ (voltage 4.5 V) for 7 minutes. Between each of the electroplating cycles a 1 minute stop was used keeping the substrates to be deposited in the chromium-containing bath but without allowing any current to pass the bath. A titanium mesh coated with MMO was used as the anodes. As a result, a first layer comprising four sublayers was formed on each of the substrate. The substrate with the first layer deposited thereon was then rinsed.

The roughness of the top surface of the first layer formed was measured and the Ra value was 0.6 μm. The thickness of the first layer was 18 μm. Before subjecting the same to the heat treatment, the top surface was polished to a Ra value of 0.2 μm.

Thereafter, a heat treatment was carried out in a furnace at a temperature of 700° C. for 60 minutes in the presence of uncoated steel that contained carbon. I.e. the heat treatment was carried out in the presence of a carbon source.

The surface roughness did not change as a result of the heat treatment and the Ra value was measured to be about 0.2 μm.

The formed chromium-based coating was analyzed by RAMAN measurements and it was noticed that on the first layer comprising predominantly chromium and chromium carbide, a chromium oxide layer was formed together with a carbon layer.

It is obvious to a person skilled in the art that with the advancement of technology, the basic idea may be implemented in various ways. The embodiments are thus not limited to the examples described above; instead, they may vary within the scope of the claims.

The embodiments described hereinbefore may be used in any combination with each other. Several of the embodiments may be combined together to form a further embodiment. An object or a method, disclosed herein, may comprise at least one of the embodiments described hereinbefore. It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items. The term "comprising" is used in this specification to mean including the feature(s) or act(s) followed thereafter, without excluding the presence of one or more additional features or acts.

The invention claimed is:

1. An object comprising a chromium-based coating on a substrate, the chromium-based coating comprising a first layer on the substrate, wherein the first layer has a top surface on the opposite side to the substrate and comprises fissures within the first layer, wherein at least some of the fissures are surrounded by the material of the first layer, and wherein the material of the first layer is predominantly formed of chromium and chromium carbide;

the chromium-based coating further comprising a second layer on the first layer, the second layer at least partially filling the fissures in the first layer and at least partially covers the top surface of the first layer, wherein the material of the second layer is selected from a group consisting of: chromium oxide, carbon, and a combination of chromium oxide and carbon.

2. The object of claim 1, wherein the material of the second layer is chromium oxide and wherein the second layer covers the entire top surface of the first layer for protecting the first layer and/or the substrate from effects of corrosion.

3. The object of claim 1, wherein the corrosion resistance of the object is at least 24 h, or at least 48 h, or at least 96 h, or at least 168 h, or at least 240 h, or at least 480 h, as determined in accordance with standard EN ISO 9227 NSS (neutral salt spray) rating 9 or 10 (2017).

4. The object of claim 1, wherein the first layer is formed of at least two sublayers arranged one upon the other.

5. The object of claim 1, wherein the second layer is at least partially embedded and/or diffused into the first layer.

6. The object of claim 1, wherein the thickness of the second layer is 5-500 nm, or 10-450 nm, or 20-400 nm, or 50-300 nm, or 60-200 nm, or 70-100 nm.

7. The object of claim 1, wherein the chromium-based coating has a Vicker microhardness value of 900-2000 HV, or 1000-1800 HV, or 1500-1700 HV.

8. The object of claim 1, wherein the substrate consists of metal, a combination of metals, or metal alloy.

9. The object of claim 1, wherein the object is a gas turbine, shock absorber, hydraulic cylinder, linked pin, joint pin, a bush ring, a round rod, a valve, a ball valve, or an engine valve.

10. A method for producing an object comprising a chromium-based coating on a substrate, wherein the method comprises:

depositing a first layer comprising a top surface on the substrate by subjecting the substrate to at least two electroplating cycles from a trivalent chromium bath, wherein the first layer comprises fissures within the first layer, wherein at least some of the fissures are surrounded by the material of the first layer, and subjecting the first layer deposited on the substrate to at least one heat treatment at a temperature of 300-1200° C. to form a second layer on the first layer, to at least partially fill fissures in the first layer and to at least partially cover the top surface of the first layer, wherein the material of the first layer is predominantly formed of chromium and chromium carbide, and wherein the material of the second layer is selected from a group consisting of: chromium oxide, carbon, and a combination of chromium oxide and carbon.

11. The method of claim 10, wherein the method comprises forming a second layer, the material of which is chromium oxide, and wherein the second layer covers the entire top surface of the first layer for protecting the first layer and/or the substrate from effects of corrosion.

12. The method of claim 10, wherein each of the at least two electroplating cycles is separated from another electroplating cycle in time so as to form a first layer of at least two sublayers arranged one upon the other.

13. The method of claim 10, wherein the method comprises polishing the top surface of the first layer before subjecting the first layer deposited on the substrate to the at least one heat treatment.

14. The method of claim 10, wherein subjecting the first layer to the at least one heat treatment comprises simultaneously exposing the first layer to reactions with carbon.

* * * * *